US008011895B2

(12) United States Patent
Ruffo

(10) Patent No.: US 8,011,895 B2
(45) Date of Patent: Sep. 6, 2011

(54) NO WATER / DEAD HEAD DETECTION PUMP PROTECTION ALGORITHM

(75) Inventor: Matthew J. Ruffo, Romulus, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 433 days.

(21) Appl. No.: 11/327,289

(22) Filed: Jan. 6, 2006

(65) Prior Publication Data

US 2007/0160480 A1 Jul. 12, 2007

(51) Int. Cl.
*F04B 49/06* (2006.01)

(52) U.S. Cl. ..... 417/44.2; 417/53

(58) Field of Classification Search ..... 417/44.1, 417/44.2, 12, 53; 702/130
See application file for complete search history.

(56) References Cited

U.S. PATENT DOCUMENTS

| | | | | |
|---|---|---|---|---|
| 4,329,120 | A | 5/1982 | Walters | |
| 5,015,151 | A | 5/1991 | Snyder, Jr. et al. | |
| 5,240,380 | A | 8/1993 | Mabe | |
| 5,580,221 | A | 12/1996 | Triezenberg | |
| 5,654,504 | A * | 8/1997 | Smith et al. | 73/152.61 |
| 5,883,489 | A | 3/1999 | Konrad | |
| 6,481,973 | B1 * | 11/2002 | Struthers | 417/36 |
| 6,739,840 | B2 * | 5/2004 | Curry et al. | 417/44.1 |
| 6,783,328 | B2 * | 8/2004 | Lucke et al. | 417/43 |
| 6,908,289 | B2 * | 6/2005 | Scanderbeg et al. | 417/32 |
| 7,080,508 | B2 * | 7/2006 | Stavale et al. | 60/431 |
| 2002/0176783 | A1 | 11/2002 | Moeller | |
| 2003/0065425 | A1 * | 4/2003 | Goodwin et al. | 700/282 |
| 2004/0213676 | A1 | 10/2004 | Phillips et al. | |
| 2005/0123408 | A1 * | 6/2005 | Koehl | 417/53 |
| 2007/0177985 | A1 * | 8/2007 | Walls et al. | 417/44.2 |

* cited by examiner

*Primary Examiner* — Devon C Kramer
*Assistant Examiner* — Amene S Bayou

(57) ABSTRACT

A method and apparatus are provided for controlling the operation of a pump in a pumping system, featuring sensing a no water or dead head condition of the flow of a medium in the pumping system operating at a set point pressure; and dynamically reducing the set-point pressure to a lower set point pressure that allows for the flow of the medium to continue at the lower set point pressure while further monitoring the flow of the medium through the pump to protect the pump against damage due to the no water or dead head condition.

18 Claims, 2 Drawing Sheets

Flowchart for No Water/Dead Head Detection Pump Protection Algorithm

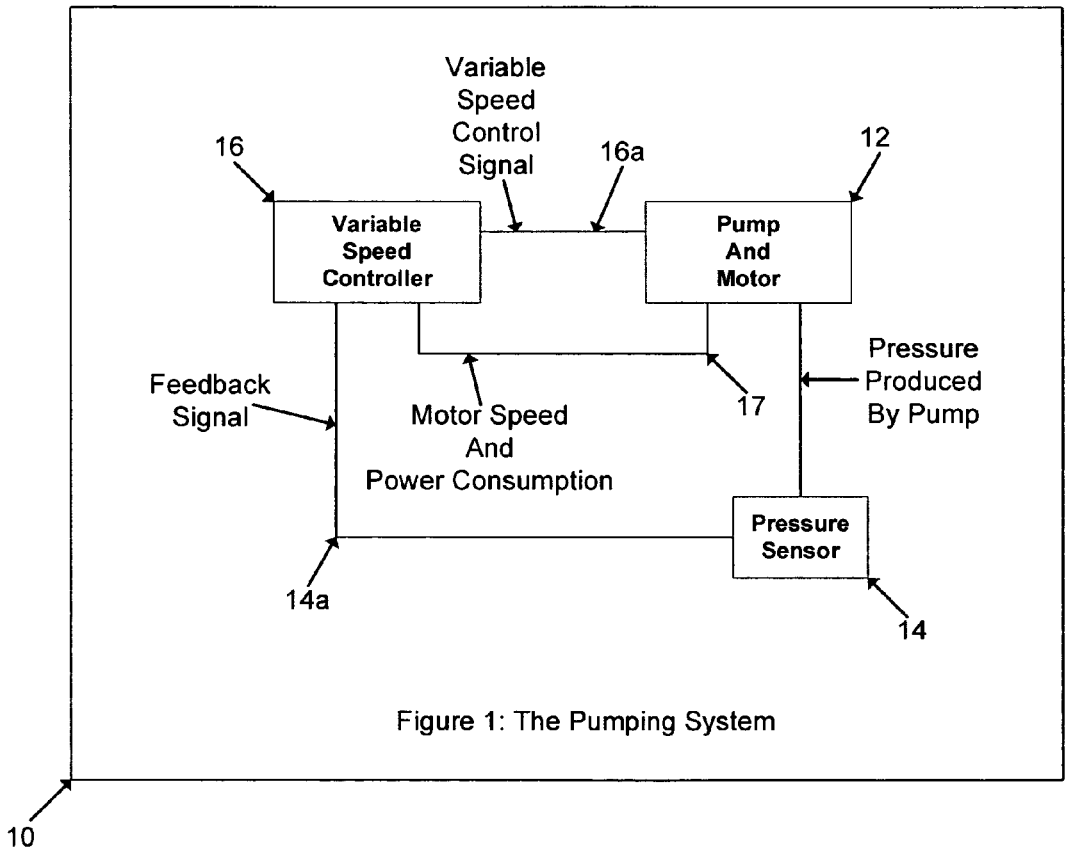
Figure 1: The Pumping System

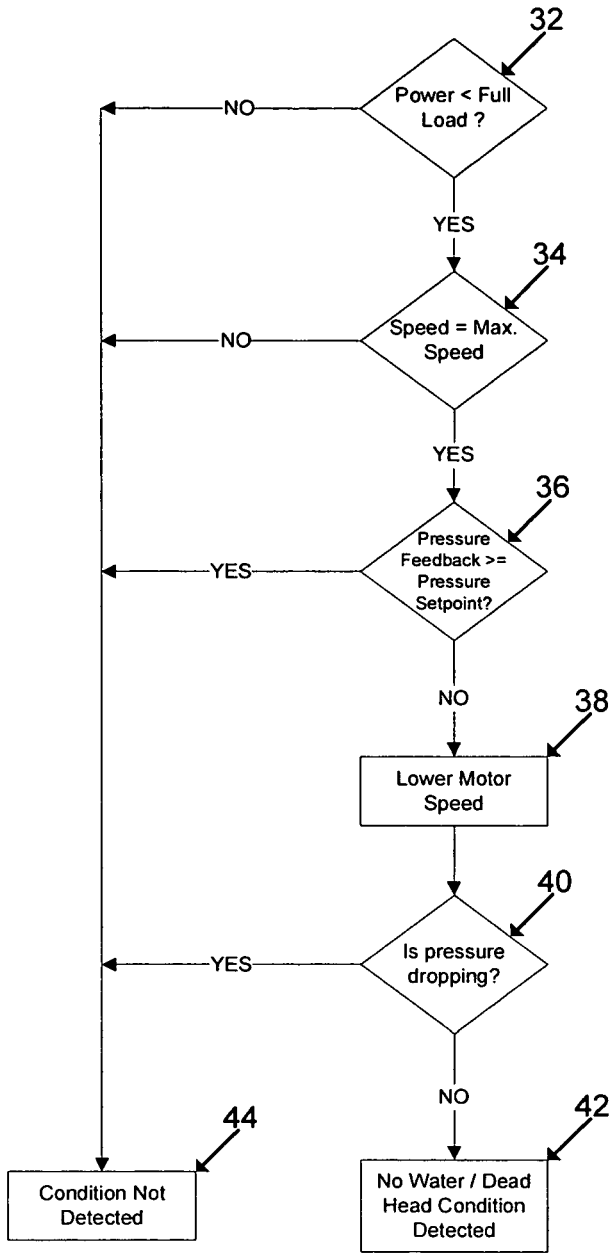
Figure 2: Flowchart for No Water/Dead Head Detection Pump Protection Algorithm
30

NO WATER / DEAD HEAD DETECTION PUMP PROTECTION ALGORITHM

BACKGROUND OF THE INVENTION

1. Field of the Invention

The present invention relates to a pumping system; and more particularly, to a pump protection algorithm for a pump in a pumping system.

2. Purpose of or Problem Solved by Invention

In known pumping systems, the system pressure is maintained constant by varying the speed of the pump. However, problems can occur with these systems when the set-point pressure is set higher than the pump can achieve. When this happens, the pump can run continuously with no flow passing through the pump. Most pumps on the market today will be damaged if they are operated in this condition. The condition described above is commonly known as a dead head condition.

Techniques are known to detect such a dead head condition; however, the pump is always turned off in order to protect it, even if the pump is able to maintain a lower pressure.

Other products and techniques are available that are designed to protect the pump from damage due to dead head or no-flow conditions. Some of these products and techniques detect these operating conditions by measuring the phase angle between the AC voltage and the AC current supplied to the motor, the system pressure, and time. In some cases, the phase angle is measured using a phase detector circuit that measures current using current transformers. However, the addition of these devices adds cost and size to these protection systems. Others measure the system pressure and magnitude of the output current. This technique can lead to false detection under certain operating conditions such as when the system is close to no flow.

In view of this, there is a need in the industry to address and solve this basic problem.

SUMMARY OF THE INVENTION

The present invention features a method and apparatus for controlling the operation of a pump in a pumping system, featuring steps of sensing a no water or dead head condition of the flow of the medium in the pump, and dynamically reducing the set-point of the pressure for monitoring the flow of the medium in response to one or more signals containing information about the motor power consumption, motor speed and system pressure. In effect, the new technique according to the present invention uses the magnitude of the motor power consumption, the motor speed, system pressure, and flow to detect a no water operating condition. This new technique is especially useful in pumping systems utilizing a variable frequency drive.

In particular, a no water operating condition may be sensed based on some combination of the magnitude of the motor power consumption, the motor speed, the system pressure, and/or the flow. The test for the no water operating condition may include the following three conditions: (1) whether the motor power consumption is below full load, (2) whether the motor speed is at full speed, and (3) whether the system pressure is below a desired operating point. The test for the no water operating condition may also include the step of lowering the pump/motor speed and checking if the system pressure drops. If the system pressure drops, then there is flow in the system so the pump will continue to run, while if the system pressure does not drop, then there is no flow in the system so the pump is turned off.

The method also includes a step of providing a feedback signal from a pressure sensor to a variable speed controller.

The apparatus may take the form of a pumping system having a pump and a variable speed controller for controlling the pump, the controller for sensing a no water or dead head condition in the pump and for dynamically reducing the set-point of the pressure for monitoring the flow of the medium in response to the no water or dead head condition. The variable speed controller runs a program having an algorithm that performs one or more of the steps set forth in the method above.

In operation, the new technique dynamically reduces the set-point in the event that the pump is in a dead head condition. This allows water service to continue at a lower pressure set-point while continuing the ability to protect the pump against damage due to a no water condition. A common example of a dead head situation is when the water level in a well drops to the point where the pump in the well can no longer maintain the set-point pressure. In this case, the new technique detects the highest achievable pressure set-point and uses that value as a temporary set-point. While operating at this temporary set-point, the flow through the pump is monitored. When flow stops, the pump is turned off. The variable speed controller can use time and/or a drop in pressure as a signal to restart the pump and motor and to see if the original set-point can now be maintained.

BRIEF DESCRIPTION OF THE DRAWING

FIG. 1 shows a pumping system according to the present invention.

FIG. 2 shows a flowchart of steps of a method for a no water/dead head detection pump protection algorithm in a pumping system such as that shown in FIG. 1 according to the present invention.

DETAILED DESCRIPTION OF THE INVENTION

The no water/dead head detection pump protection algorithm according to the present invention can be used in many types of pumping systems. By way of example, FIG. 1 shows one such pumping system generally indicated as 10 having a pump and motor 12, a pressure sensor 14, and a variable speed controller 16. The pump and motor 12 and the pressure sensor 14 are known in the art, and the scope of the invention is not intended to be limited to any particular type or kind thereof. Moreover, embodiments of the present invention are envisioned using pumps/motors and pressure sensors either now known or later developed in the future.

In operation, the pressure sensor 14 provides a feedback signal along line 14*a* to the variable speed controller 16 containing information about pressure sensed in relation to the pump and motor 12. The variable speed controller 16 varies the speed of the pump and motor 12 to maintain a constant pumping pressure with a variable speed control signal along line 16*a*. The variable speed controller 16 measures the current draw of the pump and motor 12 as well as the speed of the pump and motor 12 based on information contained in pump and motor signal along line 17.

FIG. 2 shows a flowchart generally indicated as 30 of steps of a method for a no water/dead head detection pump protection algorithm. In order to detect a no water/dead head operating condition, three conditions must be satisfied, then an additional test is performed to determine if there is flow present in the pumping system 10. The three conditions that must be true are:

1) Is the power consumption of the pump and motor 12 below full load (step 32), 2) Is the speed of the pump and motor 12 at full speed (step 34), 3) Is the pressure of the pump and motor 12 below a desired operating point (step 36).

When all three conditions are satisfied, the following additional test is performed: the variable speed controller 16 lowers the motor/pump speed in step 38, and if the pumping system pressure does not drop in step 40, then a no water/dead head condition is detected and the pump and motor 12 is turned off in step 42. Alternatively, if the pressure drops in step 40, then the no water/dead head condition is not detected and the pump and motor 12 will continue to run in step 44.

The Variable Speed Controller 16

The basic functionality of the variable speed controller 16 and the no water/dead head detection pump protection algorithm according to the present invention may be implemented as follows:

By way of example, and consistent with that described herein, the functionality of the variable speed controller 16 may be implemented using hardware, software, firmware, or a combination thereof, although the scope of the invention is not intended to be limited to any particular embodiment thereof. In a typical software implementation, the variable speed controller 16 would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology now known or later developed in the future. Moreover, the scope of the invention is intended to include the variable speed controller 16 being used as stand alone modules, as shown, or in the combination with other circuitry for implementing another module.

Although the present invention has been described in relation to a variable speed controller, embodiments of the present invention are envisioned using other types or kind of controllers either now known or later developed in the future.

Scope of the Invention

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

The invention claimed is:

1. A method for a no water/dead head detection pump protection comprising:

(1) receiving in a controller a feedback signal containing information about pressure produced by a pump and a signal containing information about motor speed and power consumption of the pump;

(2) detecting in the controller that a no water/dead head condition exists by checking if three conditions are satisfied, including:

(a) power consumption of the pump and motor is below full load, (b) the speed of the pump and motor is at full speed, and (c) the pressure of the pump is below a desired operating pressure set point;

(3) if all three conditions are satisfied, then providing a control signal to lower the speed of the motor and pump, and turning off the pump and motor if the pressure produced by the pump does not drop; and (4) if either all three conditions (a), (b) and (c) are not satisfied, or the pressure produced by the pump drops when the speed of the motor and pump is lowered; then determining that the water/dead head condition is not detected, and providing the control signal to continue to allow the pump and motor to run, and repeating step (1) of the method.

2. A method according to claim 1, wherein the pump is a centrifugal pump.

3. A method according to claim 1, wherein the controller is a variable speed controller.

4. A method according to claim 1, wherein the method further comprises dynamically reducing the desired operating pressure set-point to a lower pressure set-point in the event that the pump is in a dead head condition, so as to allows water service to continue at the lower pressure set-point while continuing the ability to protect the pump against damage due to a no water condition.

5. A method according to claim 4, wherein the method further comprises detecting a value of a highest achievable pressure set-point and using that value as a temporary set-point.

6. A method according to claim 5, wherein the method further comprises operating the pump at the temporary set-point, and monitoring the flow through the pump.

7. A controller for providing a no water/dead head detection pump protection to a pump, comprising:

a module configured to (1) receive a feedback signal containing information about pressure produced by the pump and a signal containing information about motor speed and power consumption;

(2) detect that a no water/dead head condition exists by checking if three conditions are satisfied, including:

(a) power consumption of the pump and motor is below full load, (b) the speed of the pump and motor is at full speed, and (c) the pressure of the pump is below a desired operating pressure set point;

(3) if all three conditions are satisfied, then provide a control signal to lower the speed of the motor and pump and to turn off the pump and motor if the pressure produced by the pump does not drop; and (4) if either all three conditions (a), (b) and (c) are not satisfied, or the pressure produced by the pump drops when the speed of the motor and pump is lowered, then determine that the water/dead head condition is not detected, and provide the control signal to continue to allow the pump and motor to run.

8. A controller according to claim 7, wherein the pump is a centrifugal pump.

9. A controller according to claim 7, wherein the controller is a variable speed controller.

10. A controller according to claim 7, wherein the module is further configured to dynamically reduce the desired operating pressure set-point to a lower pressure set-point in the event that the pump is in a dead head condition, so as to allows water service to continue at the lower pressure set-point while continuing the ability to protect the pump against damage due to a no water condition.

11. A controller according to claim 10, wherein the module is further configured to detect a value of a highest achievable pressure set-point and using that value as a temporary set-point.

12. A controller according to claim 11, wherein the module is further configured to operate the pump at the temporary set-point, and monitor the flow through the pump.

13. A pumping system, comprising a pump and motor configured to provide a signal containing information about a motor speed and power consumption;

a pressure sensor configured to sense pressure produced by the pump, and provide a feedback signal containing information about the pressure produced by the pump; and a controller for providing a no water/dead head detection pump protection to a pump, comprising:

a module configured to (1) receive the feedback signal containing information about pressure produced by the pump and the signal containing information about motor speed and power consumption;

(2) detect that a no water/dead head condition exists by checking if three conditions are satisfied, including:

(a) power consumption of the pump and motor is below full load, (b) the speed of the pump and motor is at full speed, and (c) the pressure of the pump is below a desired operating pressure set point;

(3) if all three conditions are satisfied, then provide a control signal to lower the speed of the motor and pump and to turn off the pump and motor if the pressure produced by the pump does not drop; and (4) if either all three conditions (a), (b) and (c) are not satisfied, or the pressure produced by the pump drops when the speed of the motor and pump is lowered, then determine that the water/dead head condition is not detected, and provide the control signal to continue to allow the pump and motor to run.

14. A pumping system according to claim 13, wherein the pump is a centrifugal pump.

15. A pumping system according to claim 13, wherein the controller is a variable speed controller.

16. A pumping system according to claim 13, wherein the module is configured to dynamically reduce the desired operating pressure set-point to a lower pressure set-point in the event that the pump is in a dead head condition, so as to allows water service to continue at the lower pressure set-point while continuing the ability to protect the pump against damage due to a no water condition.

17. A pumping system according to claim 16, wherein the module is configured to detect a value of a highest achievable pressure set-point and using that value as a temporary set-point.

18. A pumping system according to claim 17, wherein the module is configured to operate the pump at the temporary set-point, and monitoring the flow through the pump.

* * * * *